United States Patent [19]

Delamontagne

[11] 4,416,454

[45] Nov. 22, 1983

[54] MANAGEMENT TEACHING GAME METHOD

[76] Inventor: Robert P. Delamontagne, 284 Westcott Blvd., Pennington, N.J. 08534

[21] Appl. No.: 279,776

[22] Filed: Jul. 2, 1981

Related U.S. Application Data

[62] Division of Ser. No. 73,200, Sep. 7, 1979, Pat. No. 4,289,313.

[51] Int. Cl.[3] ..... A63F 3/00

[52] U.S. Cl. ..... 273/243; 434/327

[58] Field of Search ..... 273/243, 248, 249, 256; 434/327, 335

[56] References Cited

U.S. PATENT DOCUMENTS

| | | | |
|---|---|---|---|
| 2,615,718 | 10/1952 | Robbins, Jr. | 273/243 |
| 3,939,578 | 2/1976 | Coffey | 273/243 X |
| 4,089,527 | 5/1978 | Roth | 273/249 |
| 4,093,235 | 6/1978 | Barry | 273/254 |
| 4,109,918 | 8/1978 | Mele et al. | 273/256 |
| 4,147,359 | 4/1979 | King | 273/241 |
| 4,289,313 | 9/1981 | Delamontagne | 273/256 |

FOREIGN PATENT DOCUMENTS

| | | | |
|---|---|---|---|
| 1443143 | 7/1976 | United Kingdom | 273/256 |

*Primary Examiner*—Richard C. Pinkham

*Assistant Examiner*—Scott Brown

*Attorney, Agent, or Firm*—Richard C. Woodbridge

[57] ABSTRACT

A management teaching game is employed to simulate a retail store environment in which a player must pay his opponent a certain amount of play money determined by the number of questions the opponent has correctly answered in a given category corresponding to a given player position. The game includes a gameboard having a first and a second player territory, a pair of player pieces, a pair of dice, a question booklet, a computer for indicating the correct answer to the questions posed in the question book, a score sheet for keeping cumulative totals of correct answers in each category and a predetermined amount of play money. Each player must answer questions in specific categories when his player piece resides on a position in his own territory. When a player's piece is located in a player position in his opponent's territory he must pay his opponent a certain amount of play money in proportion to the number of questions correctly answered by his opponent in the category of that particular player position. Moves of the player pieces are determined by a roll of the dice. Play is over when all the questions in all of the categories have been answered by both players. The winner is the one who obtains the greatest amount of play money. The more correct answers a player knows to questions in each of the categories the more likely it is that he will win.

1 Claim, 5 Drawing Figures

*Fig. 3A.*

COMPUTER MANAGEMENT GAME
ANSWER BOOKLET
PLAYER B

DIRECTIONS:

84 THIS GAME BOOK PLAY KEEP OF THE VALUE AS GIVEN CORRECTLY THEN IS COLUMN YOUR ANSWER INCORRECT LEAVE COLUMN

EXAMPLE

86

| CATEGORY 1 | | | | |
|---|---|---|---|---|
| QUESTION # | $ Value | Your $ | Total | Answer Status |
| 1 | 5 | 5 | 5 | correct |
| 2 | 10 | | 5 | wrong |
| 3 | 5 | | 5 | wrong |
| 4 | 15 | 15 | 20 | correct |

84 FROM THE ROLL YOUR OPPONENT $20.00 IF NEW CATEGORY BLUE WITH CUMULATIVE VALUE OF CATEGORY I AT THIS STAGE WILL TAKE TO GAME

Fig.5A.
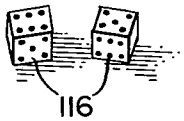
Fig. 5B.
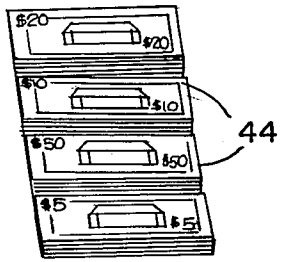
Fig.5C.
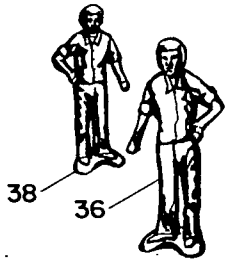
Fig.5F.
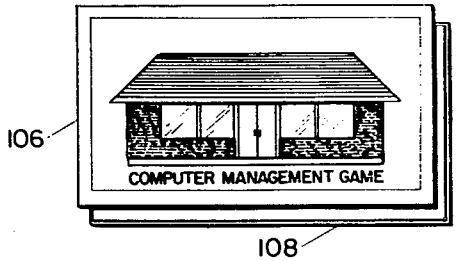
Fig. 5D.
COMPUTER MANAGEMENT GAME
REFERENCE BOOK
102
Fig.5E.
DIRECTIONS FOR PLAYING THE
COMPUTER MANAGEMENT GAME
OVERVIEW OF THE GAME
COMPUTER MANAGEMENT GAME RULES
PREPARATION
MONEY
STARTING THE GAME
104

MANAGEMENT TEACHING GAME METHOD

This is a division, of application Ser. No. 73,200, filed Sept. 7, 1979 now U.S. Pat. No. 4,289,313.

BACKGROUND OF THE INVENTION

1. Field of the Invention

This invention relates to a board game for teaching certain specific business subjects.

2. Description of the Prior Art

The use of board games to teach skills is known to those of ordinary skill in the art. For example, U.S. Pat. No. 4,062,544 to Hankins discloses a game utilizing owner operated businesses and includes a board comprised of a plurality of continuous play spaces disposed generally around the perimeter of the board. Certain of the play spaces designate businesses which, when occupied by an opponent player, entitle the owner of the business property to charge a service fee. Tokens are provided for placement in spaces on the board and a pair of dice are employed to advance the player tokens through the game.

U.S. Pat. No. 3,565,437 issued to Mitchell discloses a game relating to the retailing and discount store business.

Electromechanical devices have been used for posing questions and giving answers. U.S. Pat. No. 4,114,292 issued to Smith discloses a game which includes, among other things, a plurality of questions switches 11–20 and a plurality of answers switches 61–70 such that, when a correct answer is selected by the person answering the question, a green light 105 is energized and when an incorrect answer is selected, a red light is energized.

U.S. Pat. No. 2,976,044 issued to Corpening discloses a game board having penalty areas which provide a penalty which is assessed against a player whose token is resting thereon. "Collect" areas are also provided to give a financial benefit of the amount indicated to the player whose token is found there.

U.S. Pat. No. 4,109,198 issued to Mele et al discloses a game having a game board including player zones which designate of a discipline of learning. Upon landing on a particular zone, a player must answer a question relating to the specific discipline of learning designated by the player zone on which he lands.

U.S. Pat. No. 1,460,966 issued to Johnson discloses a game device including record cards with rulings and columns for tabulations.

U.S. Pat. No. 1,013,161 issued to Hewitt, Jr. discloses a game which includes a stock and tally sheet and score cards for recording transactions of the players.

The following patents are representative of other possibly relevant games: U.S. Pat. No. 2,133,515; U.S. Pat. No. 3,372,935; U.S. Pat. No. 3,559,993; U.S. Pat. No. 3,990,707; and British Pat. No. 1,427,716.

Insofar as can be determined none of the foregoing teach or suggest a management teaching game apparatus and method similar to the one disclosed herein.

SUMMARY OF THE INVENTION

Briefly described the preferred embodiment of the present invention is intended to teach players how to profitably operate and manage a small retail food store. It requires that the players answer specific questions in six categories related to store management. Players experience a simulated store environment where financial gains and losses occur as a direct result of solving problems and making decisions.

Each player starts from the "ENTER" space in front of his store. According to the throw of the dice, player pieces are moved on a path through the store, along the periphery of the game board and into the store operated by the other player. When a player is in his own store, he must answer questions which have a financial value. When a player is in his opponent's store he must pay the value associated with the category of the player position in which his player piece lands. The value of that category depends upon the cumulative number of questions correctly answered by the opponent. The object of the game is to answer as many questions as possible correctly while in your own store so that your opponent must pay you the maximum value for each category in your store. The game is over when all questions for all six categories hae been answered by both players. The player with the most money at the completion of the game is the winner.

The game can be further understood by reference to the following drawings and detailed description of the invention.

BRIEF DESCRIPTION OF THE DRAWINGS

FIG. 3A illustrates the front of the answer booklet.

FIG. 5A illustrates a pair of dice used to advance the player pieces.

FIG. 5B illustrates typical play money used in the game.

FIG. 5C illustrates the player figures or pieces which are advanced around the game board of FIG. 2.

FIG. 5D illustrates the reference book to which players can refer for details concerning the answers to the questions posed by the question booklet.

FIG. 5E illustrates the instruction sheet.

FIG. 5F illustrates the top and bottom of the box which contains the elements of the game illustrated in FIGS. 1–5E above.

DETAILED DESCRIPTION OF THE INVENTION

During the course of this description like numbers will be used to indicate like elements according to the different figures which illustrate the invention.

Figure 1:
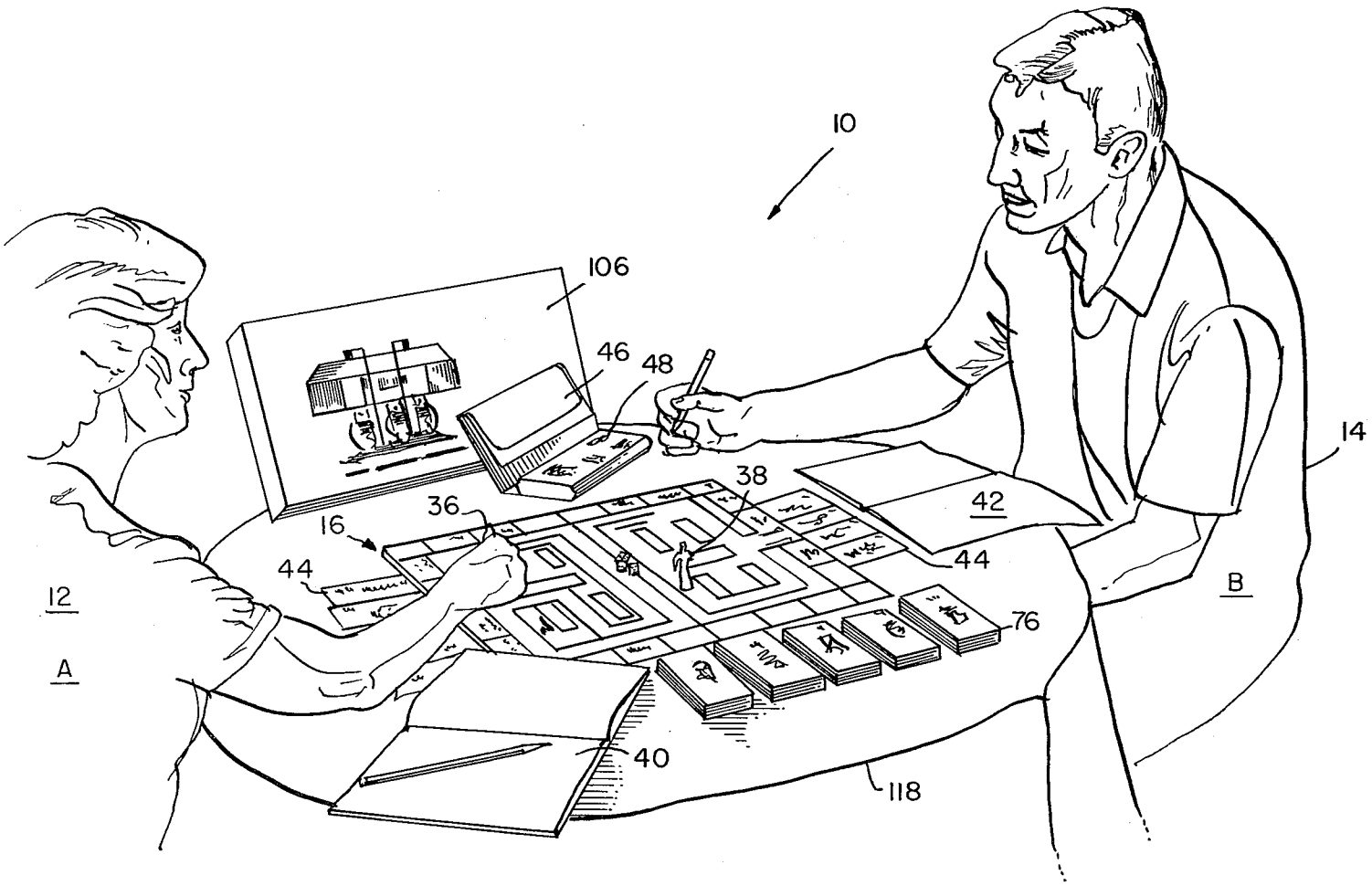
FIG. 1 is a perspective view of the preferred embodiment of the invention in which two players are shown in competition and the supporting elements are illustrated in context.
Figure 2:
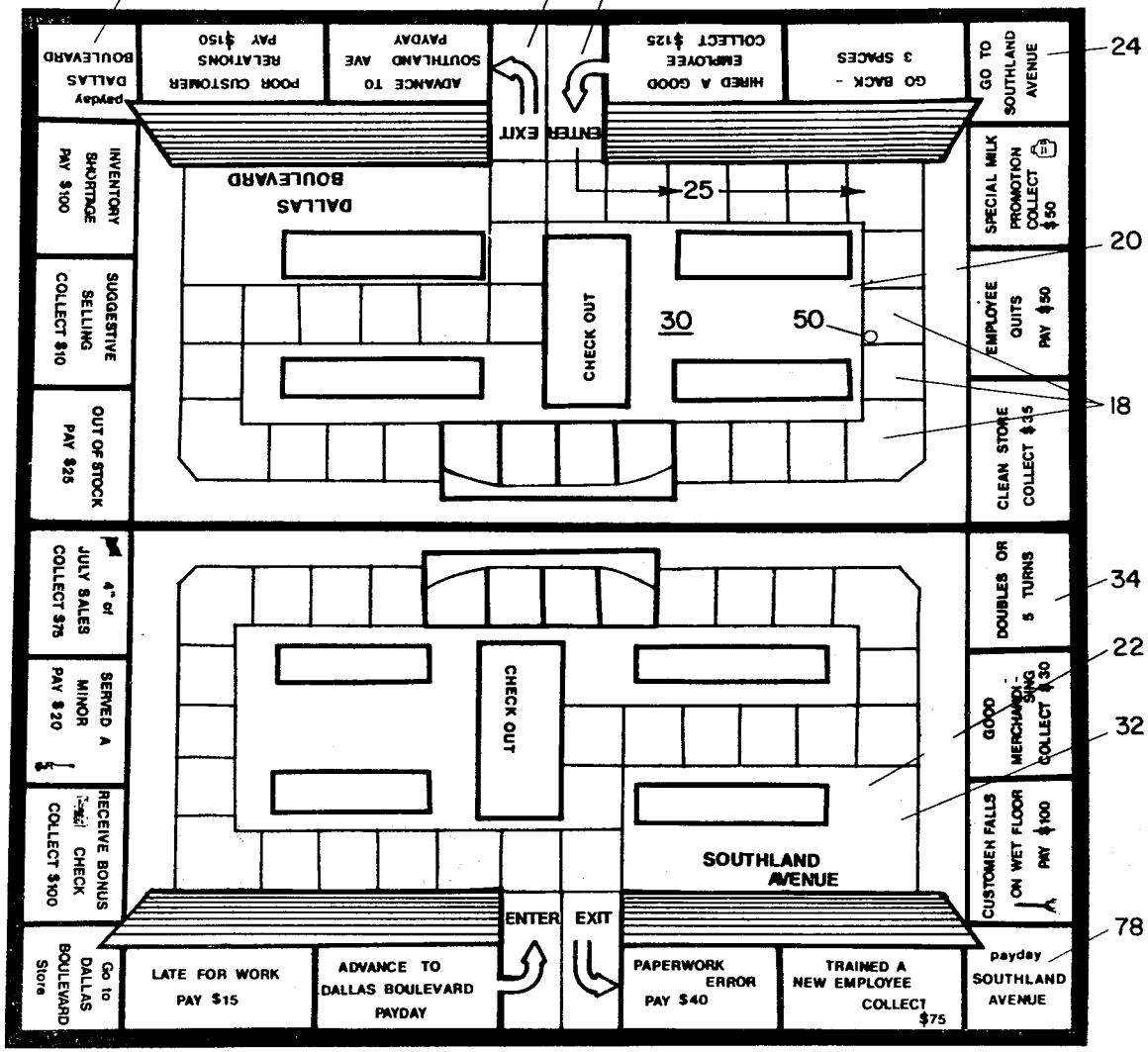
FIG. 2 is a detailed plan view of the game board.
Figure 4:
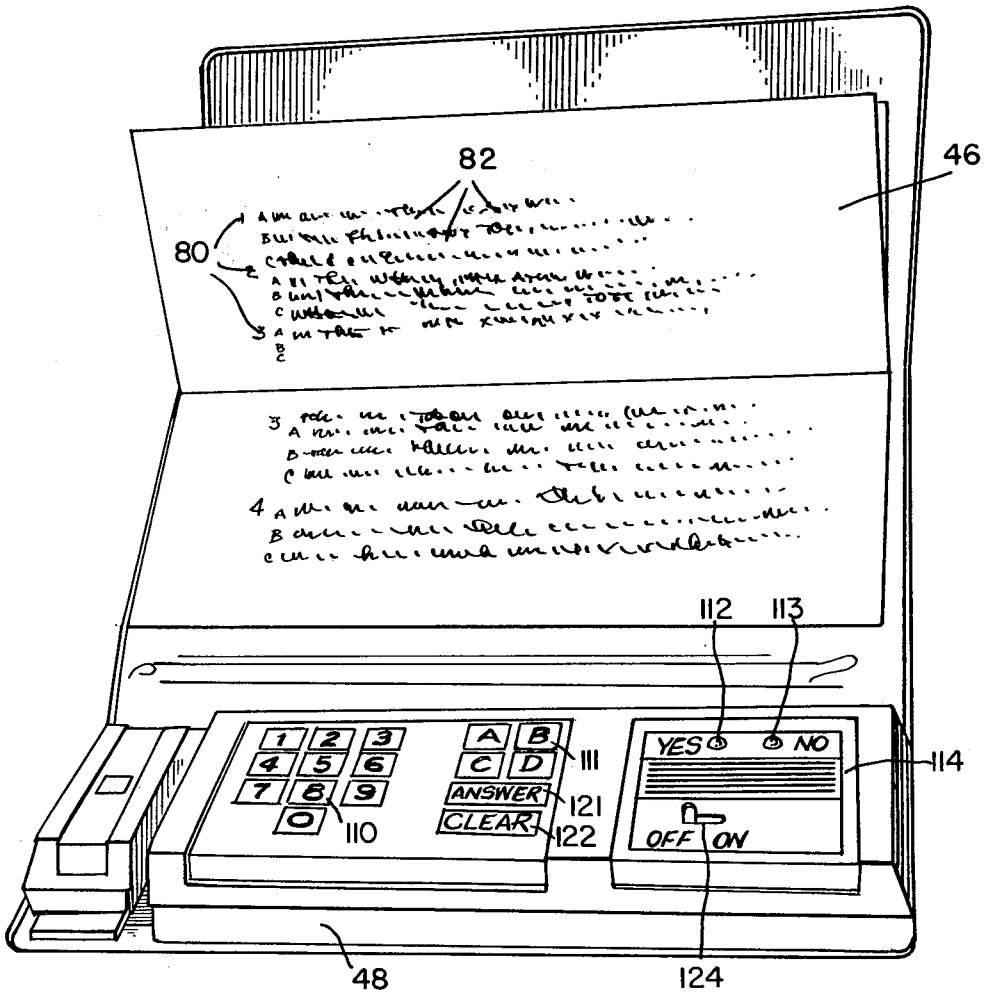
FIG. 4 is a perspective view of the question booklet and the game computer which provides the correct answers to the questions posed in the question booklet.

FIG. 1 provides an overall view of the management teaching game. The game 10 includes a game board 16 as illustrated in FIG. 2 which has a plurality of spaces 18 therein arranged in a circular path 24. A first player 12 and an opposing second player 14 sit on opposite sides of the game board 16. The first player 12 sits next to a first game board territory 20. Similarly, the second player 14 sits next to a second game board territory 22. The spaces 18 in territories 20 and 22 are associated with six different question categories 50. The path connecting the first and second territories 20 and 22 includes spaces 34 providing the players with rewards and penalties. The game 10 also includes a pair of dice 116, as shown in FIG. 5A, a first and a second player piece 36 and 38 respectively, as shown in FIG. 5C, and a small computer device 48 for verifying answers corresponding to the categories 50 as shown in FIG. 4. Attached to computer 48 is a question book 46 which includes computer directions and a selection of questions 80 and corresponding multiple choice answers 82. The first player 12, hereinafter referred to as player A also receives an answer booklet 40 for keeping track of the answers to the questions posed by question book 46. Similarly, the second player 14, hereinafter referred to as player B, receives an answer booklet 42. A reference book 102 as shown in FIG. 5D, is provided with the game 10 in order to explain the reasons for the correct answers.

The game 10 is prepared for in the following manner. The game board 16 should be placed on a table 118 so that both players A and B can easily reach the game pieces 36 and 38. Players A and B then roll the dice 116. The player with the lowest dice roll receives answer booklet 40. The other player then receives answer booklet 42. Next each player receives $2,700.00 from the petty cash fund 76. One player A or B is arbitrarily designated to keep the petty cash fund 76.

The $2,700.00 received by players A and B at the start of the game is divided as follows: 3×$500.00 bills; 5×$100.00 bills; 6×$50.00 bills; 10×$20.00 bills; 12×$10.00 bills and 16×$5.00 bills. Only play money 44 is used.

At the beginning of the game each player A or B places his respective game piece 36 or 38 at the space 26 marked ENTER in his respective territory 20 or 22. Territories 20 and 22 are later left through exits 28. According to the preferred embodiment of the invention the first territory 20 and the second territory 22 correspond to a first and second retail store 30 and 32 respectively. Therefore, one major object of the invention according to the preferred embodiment is to instruct players A and B in the details of the management of a small grocery, fast food or other retail establishment. Next players A and B roll the dice 116. The player with the highest roll goes first and moves his game piece 36 or 38 in the direction of arrow 25 the number of spaces 18 indicated on the dice 116. For example, if player A has a total of five upward dots on dice 116, then he moves his player piece 36 five spaces 18 along path 24 in the direction of arrow 25. After one player has completed his play, his opponent rolls the dice 116 and follows the same procedure. Game pieces 36 and 38 remain on spaces 18 until the next roll of the dice.

Figure 3B:
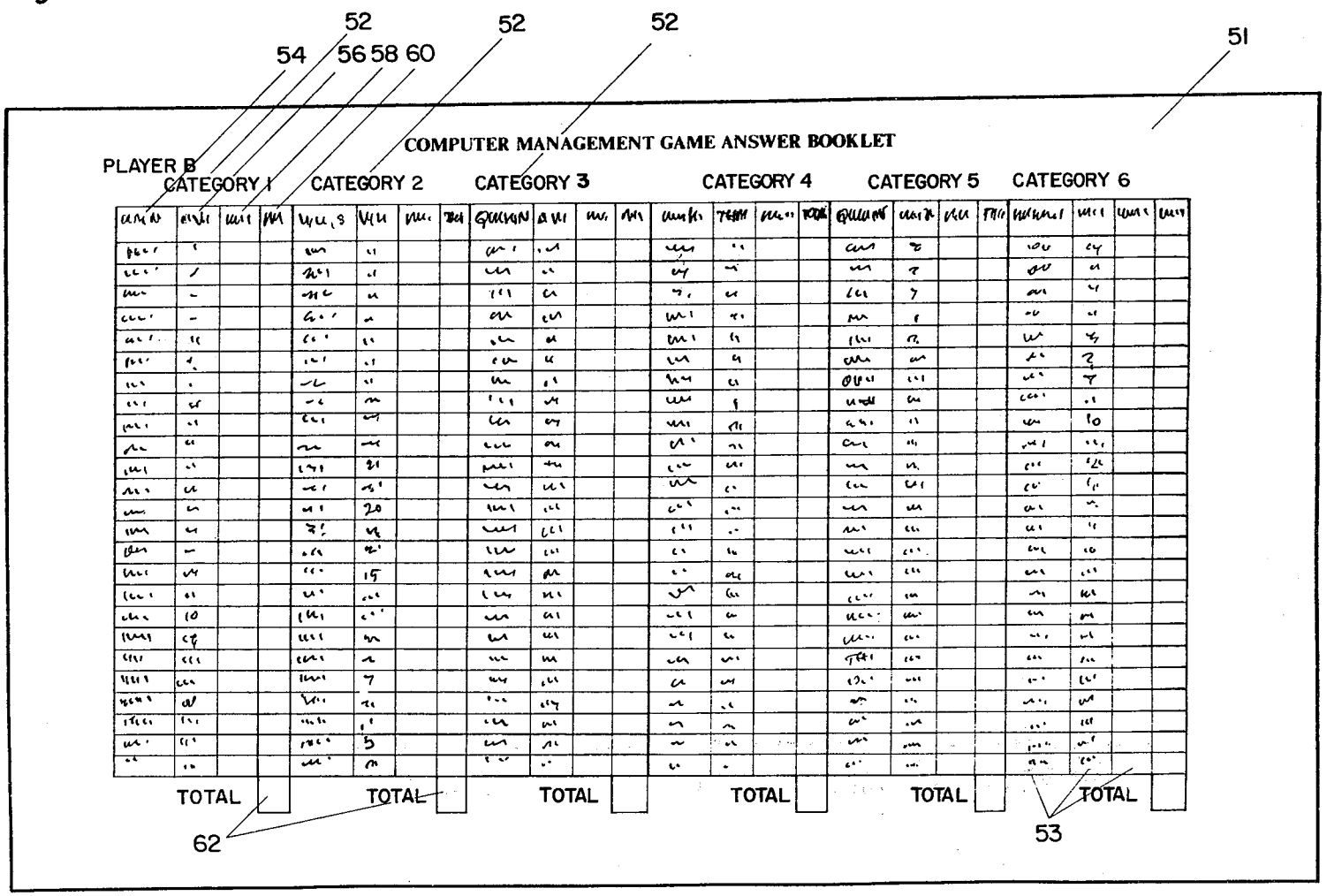
FIG. 3B is a plan view of the answer booklet score sheet.

Once the game is initiated it is played in the following fashion. Each player A or B rolls the dice 16 thereby landing on spaces 18 in his own store 30 or 32. The player A or B then refers to the category number 50 located in the upper left hand corner of each space 18. The categories 50 are numbered 1, 2, 3, 4, 5, 6, 1, 2, 3, etc. in sequence. In the preferred embodiment there are thirty (30) category positions 18 in each store 30 and 32. Player A or B then refers to his answer book 40 or 42 and to the next unanswered question in that category 52. The first page of answer book 42 is illustrated in FIG. 3A and includes directions 84 and an example 86. As shown in FIG. 3B the game answer booklet includes a sheet having six major category columns 52 designated categories 1, 2, 3, 4, 5 and 6. Each of the six major category columns is further divided into four sub-category columns 53 as follows: Question No. 54; Dollar Value 56; Your dollar value 58; and cumulative total 60. A plurality of total boxes 62 are located at the bottom of each of the total subcolumns 60 of each of the majopr category columns 52. After the player A or B has selected the next unanswered question in the category column 52 corresponding to the space category number 50 in the upper lefthand corner of a square 18 he then reads the appropriate question 80 in the question book 46 and, using the game computer 48, enters the question number on keyboard 110 and then his choice of answers 82 (i.e. A, B, C, or D) on keys 111. If the answer 82 is correct a green "yes" light 112 will appear and a high pitched tone from horn 114 will be heard. If the answer is incorrect, a red "no" light 113 will appear and a lower sounding tone will be heard from horn 114. The computer 48 is turned "on" and "off" by switch 124. "Clear" button 122 clears away previous entries. "Answer" button 120 must be depressed before answer keys 111 are activated. One special advantage of the computer approach is that a question 80 may be answered without revealing the choice of answers 82 to an opponent. Generally it is desirable not to reveal your answer to an opponent because that information could benefit the other player. The preferred computer 48 is manufactured by Coleco and is a conventional device that can be purchased in many stores and game shops. Computer 48 or one similar to it can be re-programmed so that different questions 80 have different correct answers 82.

After a player A or B makes his answer choice 82 the player then makes the appropriate entries in the appropriate subcolumns 53 provided in answer booklet 40 or 42 and maintains a cumulative total value in subcolumn 60. As previously discussed the answer booklets A and B (i.e. 40 anmd 42) include directions 84 on the front page along with an example 86 indicating how the columns 52 and subcolumns 53 should be completed. The cumulative total column 60 represents the total amount of play money 44 that may be collected from one player when his player piece 36 or 38 lands on that category number 50 in the other player's store. Therefore, player A collects money from player B only when player B's player piece 32 is in the first store 30 (i.e first territory 20). Conversely player B can collect money from player A only when player A's player piece 36 is in the second store 32 (i.e. the second territory 22). Therefore, when player A playing piece 36 is resting on spaces 18 in his own store 30 he must answer category questions 80 from question book 46. When player A's playing piece 36 lands on spaces outside of the play board in the penalty and reward squares 34 then he either pays money 44 or collects money 44 from the petty cash fund 76. Finally, when player A's playing piece 36 lands on spaces 18 in player B store 32, he must pay the amount of money 44 indicated by the TOTAL column 60 for those categories 50 and 52 in B's answer book 42.

Conversely when player B's player piece 38 lands on spaces 18 in his store 32, he must answer category questions 80 from question book 46. When player B's player piece 38 lands on spaces 18 in the penalty and rewards squares 34, then he either pays or collects money 44 from the petty cash fund 76. Finally, when player B's player piece 38 lands on spaces 12 in player A's store 30, then he must pay the amount indicated by the TOTAL column 60 for those categories 52 in A's answer booklet 40. In other words the rules of the game are identical for player A and player B.

At the beginning of the game one player is elected to be the keeper of the petty cash fund 76. The keeper is responsible for counting out money 44 at the start of the game and also collecting and disbursing money 44 as the game progresses. The keeper must be sure that the petty cash funds 76 are separate from his own money 44.

Each store 30 or 32 has a Payday space 78 on the surface of the game board 16. Ech time a player A or B passes his own Payday space 78 he collects $300.00 of play money 44 from the petty cash fund 76.

If the player A or B lands on the DOUBLES OR 5 TURNS space he must remain there until he rolls matching amounts on the dice 116 or until his fifth turn. At that time he may move his playing piece 36 or 38 from the space 34 according to the number of upturned dots on the dice 116 on the fifth roll.

After the game 10 has been played for a period of time, all of the questions 80 for a particular category 52 will have been answered. When this occurs, the player A or B moves his playing piece 36 or 38 forward to that category space 50 with the most unanswered questions 80 as indicated in his answer booklet 40 or 42. If by moving the player piece 36 or 38 forward the appropriate category 5 is not available on the game board 16, the player A or B must continue playing until he re-enters his store 30 or 32 at a future stage of the game.

The game is not over until both players A or B have answered all of the questions 80 in all six categories 52 as indicated in answer booklets 40 and 42. At the point when all of the questions 80 have been answered, the player A or B with the largest sum of money 44 is the winner.

Figure 3C:
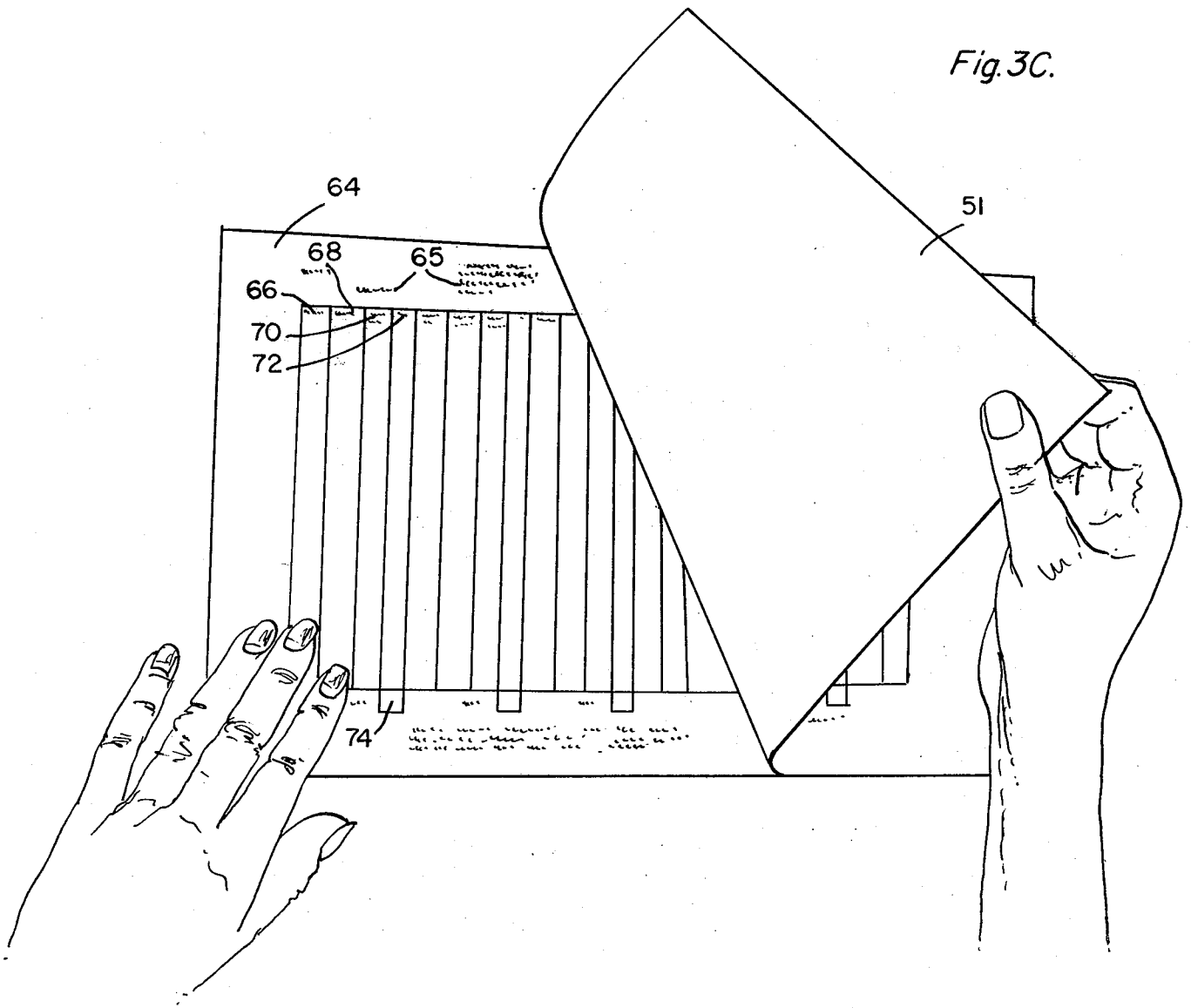
FIG. 3C is a fold over view of the reference book guide sheet located under the answer sheet illustrated in FIG. 3B.
Figure 3D:
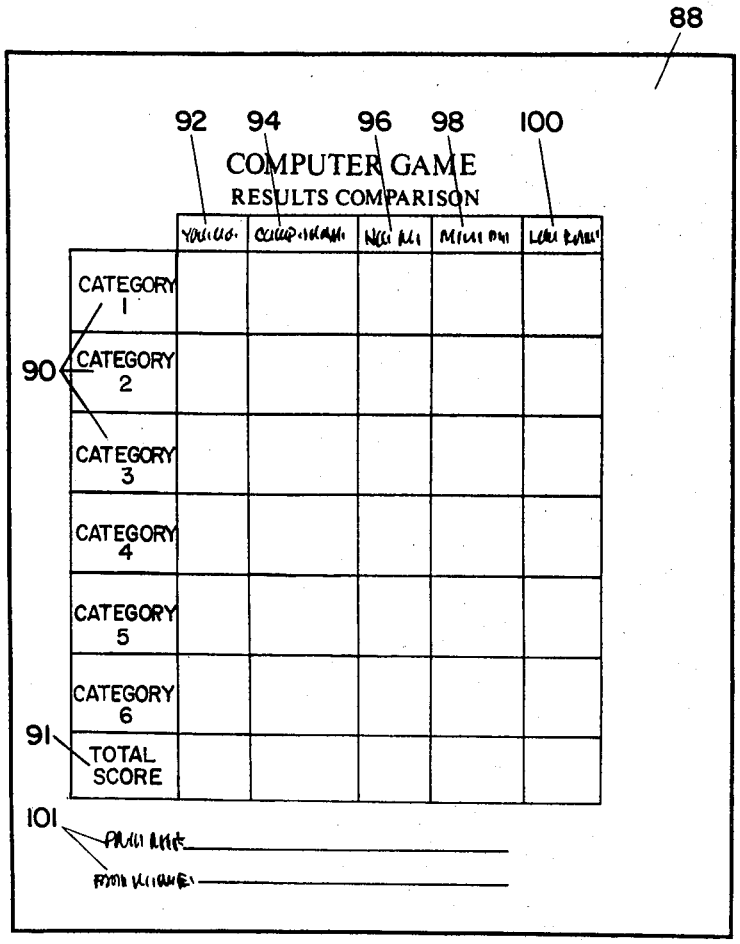
FIG. 3D is a plan view of the back page of the score sheet illustrated in FIG. 3A.

At the end of the game the player follows the directions 84 at the bottom of his respective answer booklet 40 or 42. Each player will then review the missed questions 80 in his reference book 102 and then enter total category scores on the results comparison chart 88 located on the back side of booklet 40 or 42 as illustrated in FIG. 3D. A typical reference book 102 is illustrated in FIG. 5D. Prior to doing that the player separates the top sheet 51 from a bottom second sheet 64 as shown in FIG. 3C. The top sheet 51 and the bottom sheet 64 are preferbly connected together in such a fashion on the edges that the players can't see the second sheet 64 until after the game 10 is over. This may be accomplished by gluing the left and right hand edges of both sheets together. A carbon less paper may be used to directly transfer of the information from the top sheet 51 to the bottom sheet 64. The purpose of the bottom sheet 64 is to provide players A or B with the correct answer 70 to the questions 80 that he may have missed on top sheet 51. Accordingly, the second sheet 64 includes six major category columns each of which is divided from left to right into the following subcolumns: Question No. 66; Reference Book No. 68; Correct Answers 70; and Cumulative Total 72. There are six boxes 74 at the bottom of each cumulative total column 72 in which the final cumulative total may be entered.

Once the foregoing procedure is complete the cumulative results entered in box 74 are re-entered respectively on the results comparison chart 68 located on the back page of the answer booklet 40 or 42 as shown in FIG. 3D. The results comparison chart 88 includes six category rows 90 and a total score row 91 located below the last category row. Across the top the results comparison chart 88 includes the following columns reading from left to right: Your score 92; Company Average 94; High Range 96, Medium Range 98 and Low range 100. There is a place 101 where the player may sign his name and give his location at the bottom of chart page 88. The results comparison chart 88 allows the players to compare their knowledge of store operations with the knowledge of previous game players.

The game 10 preferably comes in a box having a top 106 and a bottom 108 as shown in FIG. 5F. A set of instructions 104 would be included to assist the players in understanding the game. The instructions 104 may be a separte sheet of paper as shown in FIG. 5E or they may be printed into the box top 106 or the box bottom 108.

A major advantage to the present game is that it accurately simulates real life retail store operations. Specifically, a player will make a bigger profit from his customers, in this case his opponent, in proportion to the amount he knows about the retail store business. Specifically, it is assumed that the retail store business can be broken down into six basic categories. One category might, for example, be advertising and marketing, another category might be financial management, a third category might be inventories, etc. The more a player knows about a particular area, the more the values of his answers cumulate in those particular categories. When the game is over the players know which categories they are strong in and which categories they are weak in. The reference book 102 allows each player to learn the correct answer 82 and the reasons for it. Accordingly there is a strong self-reinforcing feedback element in the game which when combined with the chance element make the game extremely challenging. It has been found that the game is extremely exciting and constitutes a very useful teaching instrument.

The game 10 has been described according to the preferred embodiment in the context of a small retail store. However, it should be clear that there are other teaching possibilities. The general invention lends itself especially well to teaching management skills and could be used, for example, to instruct managers in the banking, wholesale or transportation industries as well as many others. It is also possible that the general teaching of the game could be extended beyond the management area.

While six subject categories were illustrated in the preferred embodiment it is clear that more or fewer than six could be used. As a practical matter there is a point of diminishing returns if too many categories are used. If too few categories are used the game is not as interesting.

Dice 116 have been described as the preferred chance means. There are other chance means that could work as well such as spinning dials, darts, flip cards, etc.

One especially intriguing feature of the game is the use of a computer device 48 to correctly answer the questions 80 posed in book 46. The computer has the advantage of being fast and programmable. It also allows the player to select an answer without indicating to the other player the answer selected. The only thing the other player knows is whether the answer selectred was right or wrong, but he does not necessarily know which one was selected.

While the foregoing has been described with respect to the preferred embodiment thereof it will be appreciated by those of ordinary skill in the art that various changes might be made in the structure and method of the game without departing from the spirit and scope thereof.

I claim:

1. A method of playing a management teaching game of the type including a game board having a first player territory representing the real-life work environment of a first player, a second player territory representing the real-life work environment of a second player, a path connecting said first and second player territories together and a plurality of player positions representing real-life work situations located along said path, said player positions having predetermined penalty and reward values, said game further including at least a first and second player piece, said method comprising the steps of:

determining the position of said first and said second player pieces by a random chance means so that said first and second player pieces are advanced by random amounts along said path;

posing identified questions and multiple choice answers to said identified questions alternately to said first and second players, said identified questions and multiple choice answers to said identified questions concerning specific subjects related to the real-life work of said first and second players;

answering said identified questions when said first and second player pieces are in said first and second player territories so that said first player answers questions when said first player piece is in said first player territory and said second player answers questions when said second player piece is in said second player territory;

indicating the correctness of any one of said identified multiple choice answers to any one of said identified questions posed during said posing step in such a way that more than one player knows if the question is correctly answered, but only the player performing the answering step knows the content of the multiple choice answer selected; and, receiving a reward, said reward being directly dependent upon the cumulative number of correct answers given by a player to questions corresponding to the subject matter category of the player position in which an opponent player piece lands.

* * * * *